United States Patent [19]

Dugas

[11] Patent Number: 4,714,909

[45] Date of Patent: Dec. 22, 1987

[54] SUPPORT FOR TRANSFORMER WINDINGS

[75] Inventor: Roger A. Dugas, Chester, N.H.

[73] Assignee: Hewlett-Packard Company, Palo Alto, Calif.

[21] Appl. No.: 738,639

[22] Filed: May 29, 1985

[51] Int. Cl.[4] ..... H01F 15/10; H01F 27/30

[52] U.S. Cl. ..... 336/192; 336/198

[58] Field of Search ..... 336/65, 92, 185, 196, 336/198, 199, 208, 192

[56] References Cited

U.S. PATENT DOCUMENTS

| | | | |
|---|---|---|---|
| 1,696,615 | 12/1928 | Trombetta | 336/185 X |
| 2,116,404 | 5/1938 | Montsinger | 331/198 X |
| 3,070,766 | 12/1962 | Purdy | 336/198 |
| 3,781,741 | 12/1973 | Weiner | 336/198 X |

FOREIGN PATENT DOCUMENTS

| | | | |
|---|---|---|---|
| 2311612 | 9/1973 | Fed. Rep. of Germany | 336/208 |
| 2651734 | 5/1978 | Fed. Rep. of Germany | 336/198 |

*Primary Examiner*—Thomas J. Kozma

*Attorney, Agent, or Firm*—Donald N. Timbie

[57] ABSTRACT

A support for transformer windings comprised of a first base having a first group of annular walls extending from one side thereof, a second base having a second group of annular walls extending from one side thereof that nest in spaces between said first group of walls, there being an aperture through which a magnetic core can be inserted within the innermost wall, a space between adjacent walls where an inner winding can be mounted, there being at least one wall from each group between said space and said aperture, and an outer winding mounted adjacent a wall, there being at least one wall from each group between the inner and outer windings.

2 Claims, 8 Drawing Figures

SUPPORT FOR TRANSFORMER WINDINGS

BACKGROUND OF THE INVENTION

Transformers having a high voltage breakdown potential between windings or between a winding and a core are usually constructed by potting the windings in material having a high dielectric constant, but this increases weight, bulk and cost and does not permit replacement of a winding when a breakdown has occurred.

BRIEF DESCRIPTION OF THE INVENTION

In accordance with this invention, a transformer having a high breakdown voltage is comprised of a first base having a first group of spaced walls extending from one side thereof, a second base having a second group of spaced walls extending from one side thereof, the dimensions and spacing of said first and second groups of walls being such that the walls of the first group are nested in the spaces between the walls of the second group. Apertures are provided through the bases into which a magnetic core can be inserted. An inner winding is mounted between adjacent walls which are so positioned that there is at least one wall from each base between the inner winding and the aperture in which the core is to be mounted, and an outer winding is mounted about a wall in such manner that there is at least one wall from each base between the windings. Preferably, the walls are annular. Although the windings may be simply inserted in the wall structure, one or both of them can be wound on a separate bobbin, and the bobbin can be nested into the wall structure. The bases and bobbin can be inexpensively molded from plastic.

With such an arrangement, the electrical impedance between the inner winding and the core or between the windings that is presented by an insulating air path defined by the walls can be made sufficient to withstand the required voltage, and the thickness of the insulating material from which the walls are made can be such that the same impedance is encountered if the path passes through a wall at any point. In the latter case, the impedance in the air path not followed is replaced by the impedance provided by the thickness of the wall through which the path passes.

BRIEF DESCRIPTION OF THE DRAWINGS

FIG. 1BD is a side view of the bases of FIGS. 1B and 1D when they are in the nested position;

FIG. 1BD' is a side view of FIG. 1BD looking into the duct D;

DETAILED DESCRIPTION OF THE INVENTION

Figure 1:
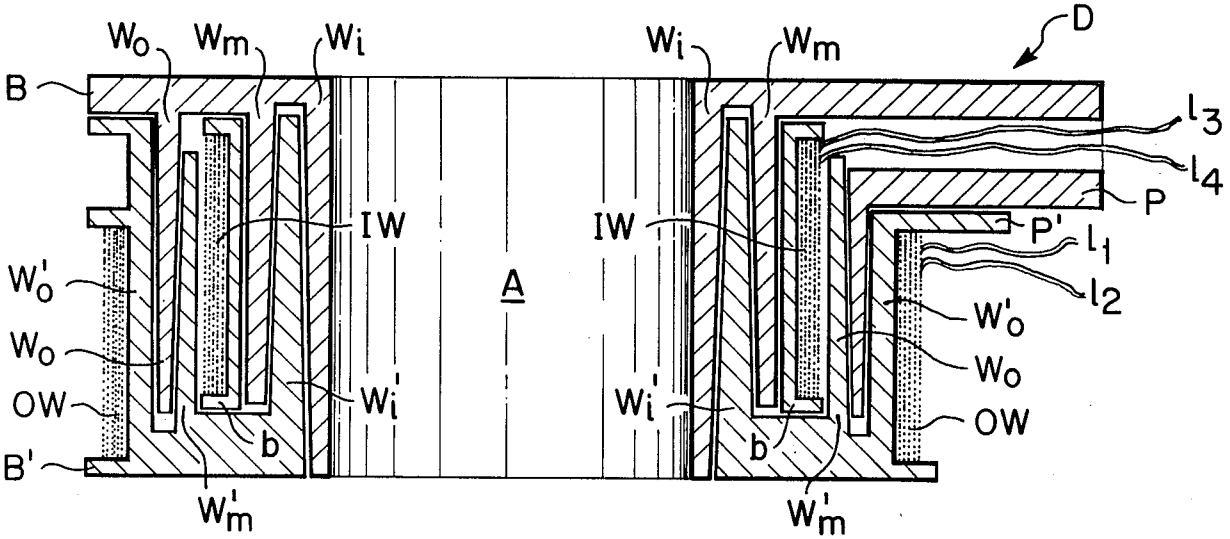
FIG. 1 is a cross section of an assembly of two bases and a bobbin taken through the axis of the aperture for a core and through the center of a duct through which the leads for the transformer windings pass.
Figure 1C:
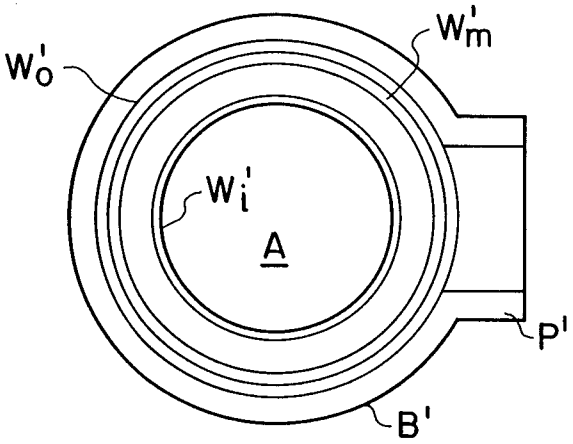
FIG. 1C is a top view of the base that is on the bottom in FIG. 1, drawn to a different scale than FIG. 1.
Figure 1A:
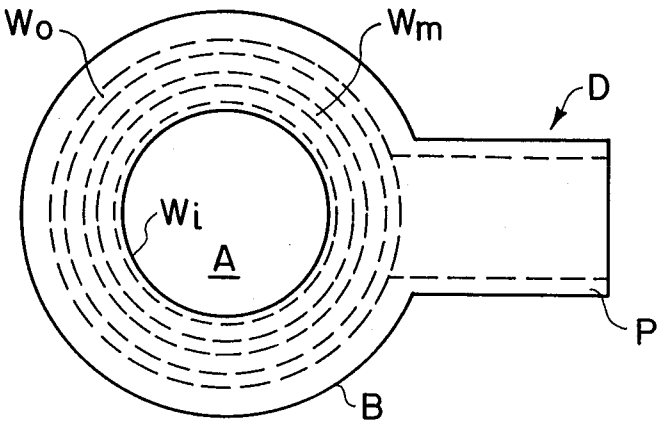
FIG. 1A is a top view of the base that is on top in FIG. 1, drawn to a different scale than FIG. 1.

In the cross section of FIG. 1, B is a base having an inner wall $W_i$, a middle wall Wm and an outer wall Wo extending downwardly therefrom, and B' is a base having an inner wall Wi', a middle wall Wm' and an outer wall Wo' extending upwardly therefrom. The inner wall $W_i$ on the base B forms an aperture A in which the magnetic core of a transformer may be inserted. The inner wall Wi' of the base B' is nested between the inner wall Wi and the middle wall Wm of the base B, and the outer wall Wo of the base B is nested between the middle wall Wm' and the outer wall Wo' of the base B'. A bobbin b, about which an inner winding IW is wound, is nested between the middle walls Wm and Wm'. An outer winding OW is placed about the outer wall Wo' of the base B'.

Whereas leads $1_1$ and $1_2$ from the ends of the outer winding OW are readily accessible, special provision must be made for access to leads $1_3$ and $1_4$ from the ends of the inner winding IW. A rectangular duct D projects radially from the top of the outer wall Wo of the top base B, and the middle wall Wm' of the bottom base B' is made shorter in the region of the duct D so as to permit the leads $1_3$ and $1_4$ to pass over its top and into the duct D. The duct D nests into a U shaped projection P extending from the wall Wo' of the base B'. This nesting is shown in FIGS. 1BD and 1BD' and prevents one base from being turned with respect to the other. More importantly, duct D and the projection P add to the air path in this area to make up for the shortening of the walls Wm', Wo and Wo'. The duct D could be parallel to the axes of walls if it is desired and the core is properly shaped.

Figure 1F:
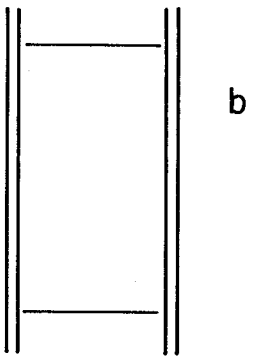
FIG. 1F shows the bobbin on which the inner winding of FIG. 1 is wound.
Figure 1D:
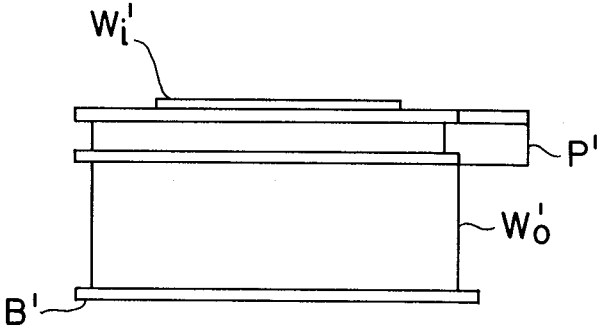
FIG. 1D is a side view of the base that is on the bottom in FIG. 1, drawn to a different scale than FIG. 1.
Figure 1B:
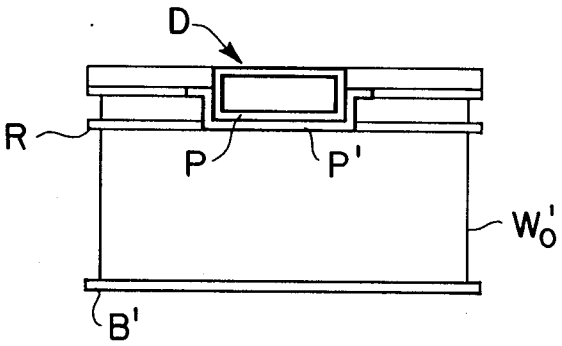
FIG. 1B is a side view of the base that is on top in FIG. 1 drawn to a different scale than FIG. 1.
Figure 1B:
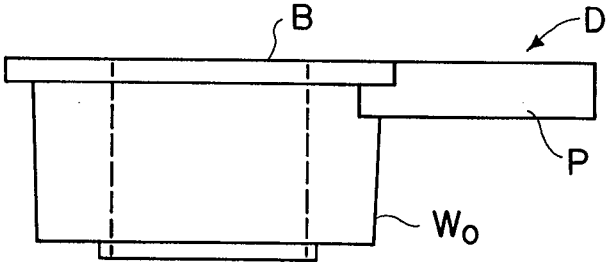
Figure 1B:
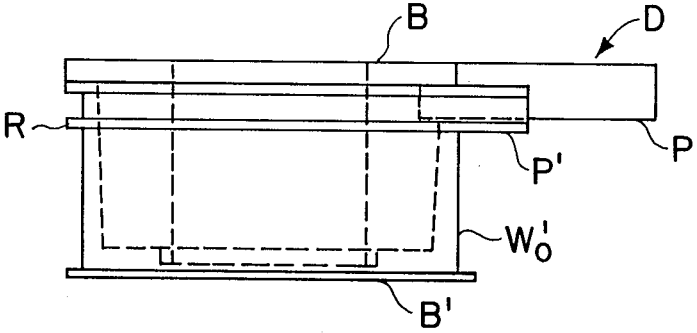

The bobbin b is shown in FIG. 1F by itself without the inner winding IW. It will be understood that the winding IW could be inserted between the walls Wm and Wm' without the bobbin b. The outer winding OW is retained in axial position by an annular ridge R extending outwardly from the outer wall Wo'.

Whereas the group of walls Wi, Wm and Wo and the group of walls Wi', Wm' and Wo' have been shown as being annular and concentric, walls having other configurations such as a square could be used if desired. Furthermore, more than two windings could be mounted in the structure with or without extra walls to provide insulation.

What is claimed is:

1. A transformer assembly that is free from potting material comprising a first base having a first group of coaxial closed walls including an inner wall extending from one side thereof and about an axis, a second base having a second group of coaxial closed walls including an inner wall extending from one side thereof about said axis, the said first and second bases being so oriented that said bases are on opposite sides of said walls and said first and second groups of walls nest within each other, means defining an aperture in said first base that is inside the inner wall extending therefrom, means defining an aperture in said second base that is inside the innerwall extending therefrom, an inner winding mounted between adjacent nested walls, there being at least one wall of each of said groups between said inner winding and the inside of the innermost of the nested walls, and an outer winding mounted about a wall, there being at least one wall from each of said groups between said inner and outer windings, and one of said bases and the outermost wall extending therefrom being shaped so as to form therebetween an outwardly extending passageway from one end of said inner winding that is closer to said one base to a point having an air path to said outer winding that is sufficiently long to prevent arc-over, and said inner winding having leads extending through said passageway.

2. A transformer assembly as set forth in claim 1 wherein said walls are annular.

* * * * *